US008003053B2

(12) United States Patent
Senftner et al.

(10) Patent No.: US 8,003,053 B2
(45) Date of Patent: Aug. 23, 2011

(54) LIQUID CONTAINER WITH VARIABLE EXTRACTION CHIMNEY

(75) Inventors: Gottfried Senftner, Lampertheim (DE); Markus Winkenbach, Burstadt (DE)

(73) Assignee: Roche Diagnostics Operations, Inc., Indianapolis, IN (US)

( * ) Notice: Subject to any disclaimer, the term of this patent is extended or adjusted under 35 U.S.C. 154(b) by 240 days.

(21) Appl. No.: 12/127,880

(22) Filed: May 28, 2008

(65) Prior Publication Data

US 2008/0299011 A1 Dec. 4, 2008

(30) Foreign Application Priority Data

May 31, 2007 (EP) ..... 07010826

(51) Int. Cl.
*B01L 3/00* (2006.01)

(52) U.S. Cl. ..... 422/68.1; 422/63; 220/501; 206/730

(58) Field of Classification Search ..... 422/68.1, 422/63; 220/501; 206/730
See application file for complete search history.

(56) References Cited

U.S. PATENT DOCUMENTS

| | | | | |
|---|---|---|---|---|
| 3,139,121 | A | 6/1964 | Ballin | |
| 5,102,631 | A * | 4/1992 | Jordan et al. | 422/42 |
| 6,726,879 | B2 * | 4/2004 | Ng et al. | 422/58 |
| 2003/0129767 | A1 * | 7/2003 | Bautista et al. | 436/178 |

FOREIGN PATENT DOCUMENTS

| | | | |
|---|---|---|---|
| BE | 533852 | A | 12/1954 |
| DE | 3838278 | C1 | 1/1990 |
| DE | 19536789 | A1 | 4/1997 |
| WO | 03/106292 | A1 | 12/2003 |

OTHER PUBLICATIONS

European Search Report for Application No. EP 07 010 826.1 dated Nov. 22, 2007.

* cited by examiner

*Primary Examiner* — In Suk Bullock
*Assistant Examiner* — Timothy G Kingan
(74) *Attorney, Agent, or Firm* — Dinsmore & Shohl LLP

(57) ABSTRACT

A liquid container having a top opening, a base, and an extraction chimney which extends into the container and which is in alignment with the top opening is presented. The extraction chimney is intended for the withdrawal of liquid by a liquid-withdrawal element that is introduced into the liquid container through the extraction chimney. The extraction chimney has a liquid-permeable zone in its bottom region, adjacent to the liquid container base. The liquid permeability of the liquid-permeable zone of the extraction chimney can be adjusted between a setting for minimal liquid permeability and a setting for greater liquid permeability. The extraction chimney can be adjusted while the extraction chimney remains in the liquid container.

20 Claims, 3 Drawing Sheets

LIQUID CONTAINER WITH VARIABLE EXTRACTION CHIMNEY

CROSS-REFERENCE TO RELATED APPLICATIONS

This application claims priority benefit to European Patent Application Number EP 07 010 826.1, filed May 31, 2007.

FIELD OF THE INVENTION

The present invention relates to liquid containers used in high throughput automatic analyzers, and in particular, to a liquid container used as a reagent liquid vessel in automatic analyzers having a top opening and having a tube-like extraction chimney which extends into the liquid container and is in alignment with the top opening and is intended for the extraction of liquid by an extraction element, such as, for example, a pipette, which can be introduced into the extraction chimney through the top opening.

BACKGROUND OF THE INVENTION

Liquid containers which are used as reagent liquid vessels in automatic analyzers can have reagent liquid extracted from them by automatic pipetting. In general, the pipetting takes place, in more modern systems, at high speeds in order to allow a high throughput of relevant analysis operations. The liquid containers are typically supplied quickly to the pipetting station by a method of transporting, e.g. by a rotor, and are stopped in a pipetting zone of the pipetting station, whereupon an automatic pipette or suction needle penetrates the top opening of the liquid container through an extraction chimney in order to extract liquid in the liquid container by suction.

For the example of automatic high throughput analyzers, an extremely short cycle time of only a few seconds is allowed for each individual pipetting operation, which includes the positioning of the liquid container in the pipetting zone. This short cycle time gives rise to the problem where, when the liquid container is stopped abruptly in the pipetting zone, the liquid sloshes in the container and possibly sprays upwards. A typical waiting period for the liquid to settle in the container is typically longer than the short pipetting cycle time required for high throughput operation. Pipetting in the presence of a fluctuating liquid level in the extraction chimney typically should be avoided since a relatively large region of the outside of pipette tip may become undesirably wetted with the liquid and a comparatively large volume of liquid may remain on the outside of the pipette tip as the pipette is withdrawn from the liquid container. This remaining liquid then may give rise to contamination in further pipetting operations.

In order to avoid this possible source of contamination, the pipette tip, during pipetting, should only penetrate the slightest possible amount of liquid in the container. Therefore, the liquid in the liquid container should be, as much as possible, at rest. Additionally, the pipette should also avoid encountering air on account of a fluctuating liquid level. Further still, the formation of foam in the extraction chimney should be prevented.

Regarding prior art relating to reaction liquid containers with an extraction chimney, reference may be made, for example, to WO 97/12677 A1, to U.S. Pat. No. 5,102,631 or to DE 38 38 278 C1. In the case of the liquid container disclosed in WO 97/12677 A1, a tubular extraction chimney is provided with a radially outwardly projecting flange at its top end. The tubular extraction chimney is supported by the projecting flange in a hanging state on a nozzle of the liquid container top opening. The completely open bottom end of the extraction chimney extends to the vicinity of the base of the liquid container. Liquid communication between the extraction chimney and the interior region of the liquid container which encloses the extraction chimney can take place only via a narrow base gap at the bottom opening of the extraction chimney. In order for pressure equalization to take place between the interior of the liquid container and the surroundings during pipetting, slot-like wall-thickness reductions are provided in the top region of the extraction chimney. These reductions are intended to allow air to flow in between the opening nozzle at the top of the liquid container and the lateral surface of the extraction chimney.

DE 38 38 278 C1 discloses a liquid container having an extraction chimney with a cross section that is significantly smaller than the cross section of the top opening of the liquid container. The extraction chimney passes through the top opening and is affixed to a screw top. The screw top is screwed to an opening nozzle. A through-hole in the screw top allows pressure equalization between the liquid container interior and the external surroundings. The extraction chimney extends into the liquid container to the vicinity of the container base. The exchange of liquid between the extraction chimney and the liquid container interior takes place by way of the open underside of the extraction chimney. In a further exemplary embodiment disclosed in DE 38 38 278 C1, the outer circumference of top end of the extraction chimney and the inner circumference of the nozzle which encloses the top end of the extraction chimney are only slightly different. In this case, there is no ventilation path of sufficient magnitude for pressure equalization between the liquid container interior and the surroundings between the outside of the extraction chimney and the inner surface of the opening nozzle. For pressure-equalization purposes, a through-bore is provided in the lateral surface of the top end of the extraction chimney. The extraction chimney is essentially completely open at its bottom end. Spacing webs are provided at the bottom end of the extraction chimney.

The liquid container disclosed in U.S. Pat. No. 5,102,631 is of similar construction to the second exemplary embodiment from DE 38 38 278 C1 and thus likewise has a through-hole in the lateral surface of top end of the extraction chimney. The extraction chimney extends through the liquid container to the vicinity of the base of the liquid container. Large lateral openings are provided in the lateral surface at the bottom end of the extraction chimney.

In accordance with the basic functional principle of the extraction chimney, a small spacing is typically formed between the bottom of the extraction chimney and the container base located opposite the extraction chimney bottom. Therefore, a narrow flow gap for forming high flow resistance exists. Fluctuations in the liquid container volume outside the extraction chimney can act within the extraction chimney at best in a damped state. The known extraction chimneys thus typically have, in their bottom regions adjacent to the container base, a liquid-permeable zone with a low level of liquid permeability.

However, this restriction of the liquid permeability, which is necessary for the desired functioning of the extraction chimney, is also associated with a disadvantage. Namely, such liquid containers initially have to be filled with liquid through the top opening of the extraction chimney. Filling has to take place very slowly because of the low level of liquid permeability in the liquid-permeable zone. The filling liquid level in the extraction chimney rises much more quickly than the filling liquid level in the liquid container outside the extraction chimney. Therefore, filling the liquid container too quickly may result in the liquid overflowing at the top opening of the liquid container.

Even conventional liquid containers in which the extraction chimneys are to be inserted after the liquid has been introduced into the liquid containers may have the problem of overflow of liquid through the top container openings. Overflow can only be avoided if the extraction chimneys are introduced comparatively slowly into the liquid containers due to the low level of liquid permeability in the liquid-permeable zones in order to prevent the liquid from rising up too quickly into the bottom end of the extraction chimneys.

It is against the above background that the present invention provides a liquid container that can be filled, if required, quickly through the top opening and through the extraction chimney and that, during liquid-extraction operation, has a settled liquid level within the extraction chimney in comparison to any fluctuations in the liquid container region outside the extraction chimney.

BRIEF SUMMARY OF THE INVENTION

According to the present invention, a liquid container filled with liquid for use in high throughput automatic analyzers can comprise a top opening, an extraction chimney and a base. The extraction chimney can extend into the liquid container and can be aligned with the top opening of the liquid container. The extraction chimney can comprise a liquid-permeable zone that can be proximate to a bottom region of the extraction chimney and can be adjacent to the base of the liquid container. The liquid permeability of the liquid-permeable zone of the extraction chimney can be adjusted between a setting of minimal liquid permeability and a setting for greater liquid permeability. The extraction chimney can remain in the liquid container during the adjustment of the liquid permeability. The liquid can then be withdrawn from the liquid container by a liquid extraction element, such as, for example, a pipette, introduced into the extraction chimney through the top opening when the liquid permeability is set at the setting of minimal liquid permeability.

In accordance with one embodiment of the present invention, a method of preparing a liquid container for providing a liquid in an automatic analyzer is disclosed. The method can comprises providing the liquid container in an automatic filling station, ensuring that the extraction chimney in the liquid container has been set to the position for a relatively high level of liquid permeability of the liquid-permeable zone, introducing the liquid through the extraction chimney into the liquid container with the extraction chimney set to the position for a relatively high level of liquid permeability of the liquid-permeable zone, closing the liquid container, and setting the extraction chimney to the position for minimal liquid permeability of the liquid-permeable zone as a preparation step for the extraction of liquid from the container.

Accordingly, it is a feature of the embodiments of the present invention to provide a liquid container that can be filled, if required, quickly through the top opening and through the extraction chimney and that, during liquid-extraction operation, has a settled liquid level within the extraction chimney in comparison to any fluctuations in the liquid container region outside the extraction chimney. Other features of the embodiments of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1B:
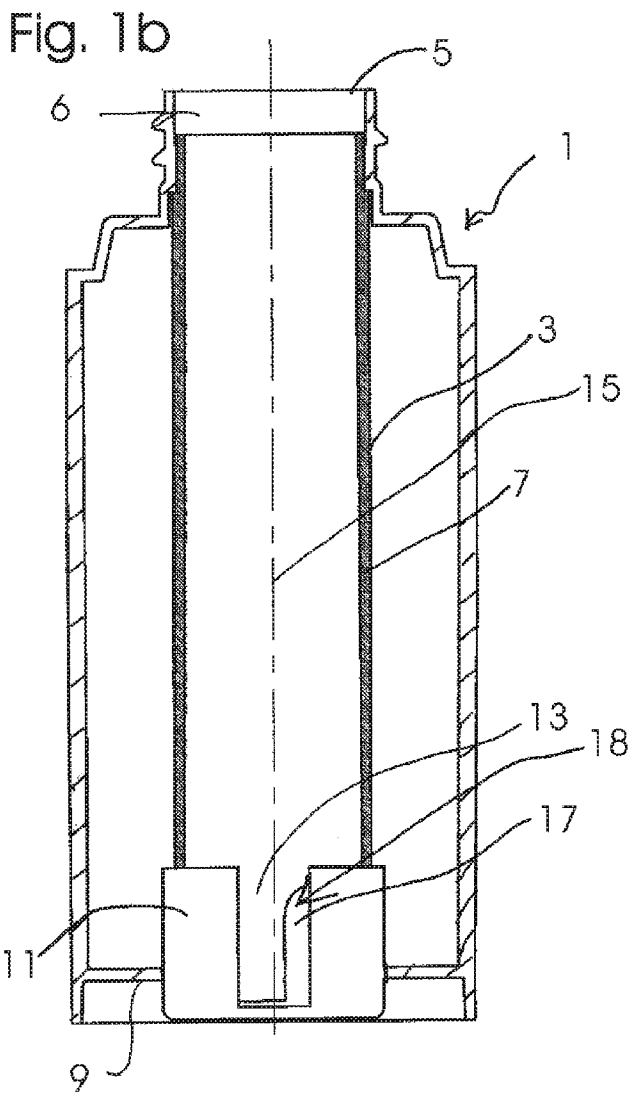
FIGS. 1A-B illustrate a sectional illustration of a first exemplary embodiment of a liquid container according to the present invention having an extraction chimney with two different limit settings for the opening cross section of the liquid-permeable zone of the extraction chimney.

In the following detailed description of the embodiments, reference is made to the accompanying drawings that form a part hereof, and in which are shown by way of illustration, and not by way of limitation, specific embodiments in which the invention may be practiced. It is to be understood that other embodiments may be utilized and that logical, mechanical and electrical changes may be made without departing from the spirit and scope of the present invention.

A particularly advantageous use of the liquid container according to the present invention can be the way the liquid can be introduced into the liquid container at a high-speed automatic filling station. During high throughput operation to prepare the liquid container for subsequently providing the liquid in a high-speed automatic analyzer, the extraction of liquid in the automatic analyzer taking place by virtue of liquid being extracted from the liquid container by suction using a pipette or the like, with the extraction chimney set to the position for minimal liquid permeability of the liquid-permeable zone. High throughput operation in the automatic filling station and high throughput operation in the automatic analyzer are thus possible using the liquid container.

To adjust the level of liquid permeability in the liquid-permeable zone of the extraction chimney, the extraction chimney can be adjusted between a setting for minimal liquid permeability and a setting for greater liquid permeability while the extraction chimney remains within the liquid container.

The extraction chimney can have a tube portion extending downwards from the top opening and a tube holder for the tube portion. The tube holder can be provided on the container base. The tube portion and the tube holder can be fitted one inside the other and can be adjusted relative to one another in order to change the opening cross section of a liquid-permeable zone. The liquid-permeable zone can incorporate lateral openings in the tube portion located in the bottom region of the extraction chimney and lateral openings in the tube holder. The lateral openings of the tube portion and lateral openings of the tube holder can be aligned relative to one another in order to increase the opening cross section of the liquid-permeable zone.

To fill the liquid container, the extraction chimney, and thus the liquid-permeable zone, can be set, for example, such that the liquid permeability can be at a relatively high level. Following the filling operation, the liquid-permeable zone can then be returned to a state of low liquid permeability. When the liquid-permeable zone is in the low state, the extraction chimney can perform its desired function during liquid-extraction operation of the liquid container. In particular, the liquid permeability of the liquid-permeable zone cannot be fully suppressed in any of the settings of the extraction chimney. In the position for minimal liquid permeability, the exchange of liquid can thus take place between the extraction chimney and the container body which encloses it.

The liquid-permeable zone can comprises at least one opening in the bottom of the extraction chimney with a cross section which can be adjusted. The cross section can be adjusted by a rotary movement and/or lifting movement of the extraction chimney relative to the liquid container base.

Stop means and/or latching means and/or markings can be provided on the extraction chimney and/or on the container body in order to define the settings for minimal liquid permeability and greater liquid permeability of the liquid-permeable zone.

The permeability of the liquid-permeable zone can be changed simply by the tube portion of the extraction chimney. The tube portion can extend from the top opening of the liquid container to the vicinity of the container base. When the tube is move up closer to the container base, a small throughflow gap can remain between the container base and the bottom of the tube portion. This small throughflow gap can then be the state for the lower level of liquid permeability of the liquid-permeable zone. By virtue of the tube portion being raised, and of the associated increase in the spacing between the bottom of the tube portion and the container base, the liquid permeability of the liquid-permeable zone can then be increased.

The extraction chimney can be secured in the liquid container. In this embodiment, even when the liquid container is open, the extraction chimney cannot be removed from the liquid container under normal handling conditions.

Setting the extraction chimney to the position for greater liquid permeability can take place prior to the liquid container being introduced into the automatic filling station or thereafter. The factor is for the normally automatic and rapidly carried out introduction step to take place with the extraction chimney set to the position for greater liquid permeability of the liquid-permeable zone.

Setting the extraction chimney to the position for minimal liquid permeability can take place following the filling operation. It can be possible for this preparation step for the extraction of liquid from the contain to take place prior to the liquid container being closed or thereafter and, if appropriate, at a different location, for example in an automatic analyzer.

In all of the figures, a vertical longitudinal section runs centrally through the extraction chimney 3 or 3*a*.

Figure 1A:
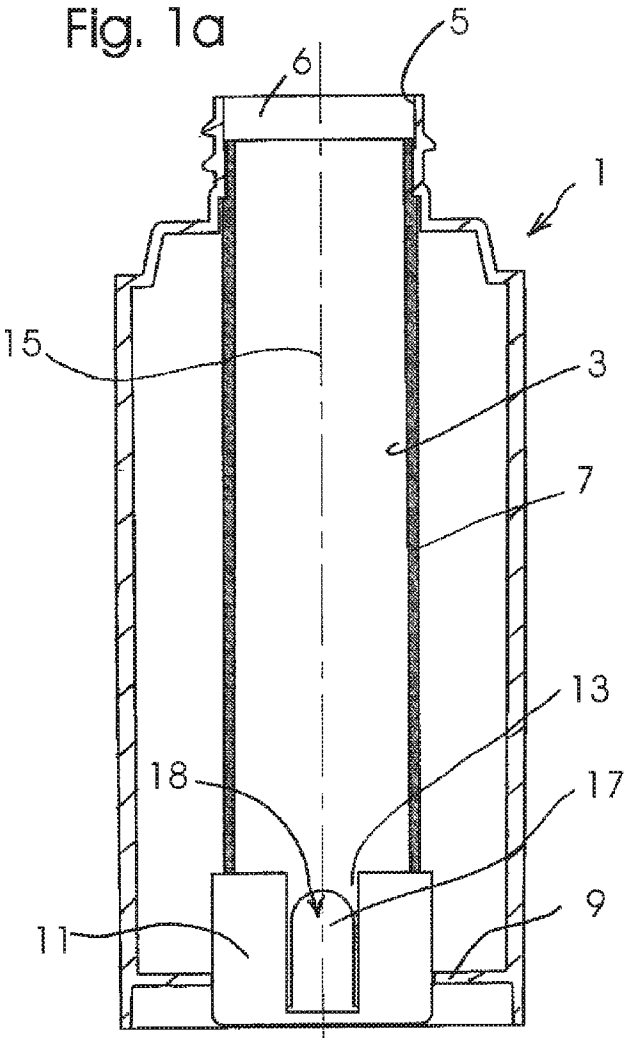

Referring initially to FIG. 1, the liquid container 1 may be a reagent liquid vessel for use in automatic analyzers in the manner as is known in the art. The liquid container 1 can have at its top end, an opening 5, from which a tube portion 7 of the extraction chimney 3 may extend vertically into the container interior. The opening 5 may have a screw-type closure. The container base 9 can have a tube holder 11. The tube holder 11 may have, for example, a cup-like form with two rectangular cutouts, or lateral opening, 13 which may be opened towards the top. As seen in FIGS. 1*a* and 1*b*, the cutouts 13 may be aligned one behind the other or may be aligned on diametrically opposite sides of the tube holders 11.

The bottom portion of the tube portion 7 may be accommodated into the tube holder 11. In other words, the tube portion 7 may have its outer circumference closely adjacent to the inner circumference of the tube holder 11 and can be located opposite the same, in contact therewith. The tube holder 11 thus can form a rotary bearing for the tube portion 7 of the extraction chimney 3. The tube portion 7 can be rotated about the vertical axis of rotation 15 between two defined rotary stop positions. Lateral cutouts 17 can be provided on diametrically opposite regions of the tube portion 7. The lateral cutouts 17 may not extend upwards beyond the uppermost periphery of the tube holder 11. The lateral cutouts 17 can be rotated relative to the cutouts 13 of the tube holder. The cutouts 17 and 13 can constitute lateral openings in the tube portion 7 and in the tube holder and, together, can form a liquid-permeable zone 18 of the extraction chimney 3. The cross section of this liquid-permeable zone 18 may depend on the extent to which the lateral openings 17 of the tube portion 7 are aligned with the lateral openings 13 of the tube holder 11.

In FIG. 1*a*, the lateral openings 17 of the tube portion 7 are fully aligned with the lateral openings 13. In this case, the openings 13, 17 can exhibit a maximum overlap. This overlap can be the limit position for the maximum cross section of the liquid-permeable zone 18 of the extraction chimney 3, or the defined setting for the relatively high level of liquid permeability of the liquid-permeable zone 18. In this position, relatively good exchange of liquid can take place between the interior of the extraction chimney 3 and the liquid container 1 volume outside the extraction chimney 3, which can be important for the operation of filling the liquid container 1 through the opening 5 and the extraction chimney 3.

Typically, for subsequent liquid-extraction operation, in the case of which liquid is to be extracted by suction from the extraction chimney 3 from above using a pipette or suction needle, good liquid communication between the interior of the extraction chimney and the container volume outside the extraction chimney can be disadvantageous since fluctuations of the liquid in the container volume outside the extraction chimney 3 can be quickly transferred, with only low-level damping, to the interior of the extraction chimney 3. This problem can be solved by the liquid container according to FIGS. 1*a* and 1*b* in that, by virtue of the tube portion 7 can be rotated relative to the tube holder 11 of the extraction chimney 3. Thereby, the common cross section of the lateral openings 13 and 17 of the tube portion 7 and of the tube holder 11 can be set to a smaller value, as illustrated in FIG. 1*b*. FIG. 1*b* shows the extraction chimney 3 in the limit position for minimal liquid permeability of the zone 18, with a small effective opening cross section of the liquid-permeable zone 18, as should be selected for liquid-extraction operation. Rotary stops can prevent the tube portion 7 from being rotated beyond the limit settings shown are not shown in FIGS. 1*a* and 1*b*.

It should be noted that the figures do not depict ventilation channels or spacing indents between the inner surface 6 of the screw-closure nozzle and the outer circumference of the tube portion 7 or ventilation openings in the top region of the tube portion 7, which can ensure pressure equalization between the external surroundings and the container interior, since they do not form part of the main aspect of the present invention. However, such ventilation measures can be taken in practice as is known in the art. This also applies to a second exemplary embodiment illustrated in FIGS. 2*a* and 2*b*.

Figure 2B:
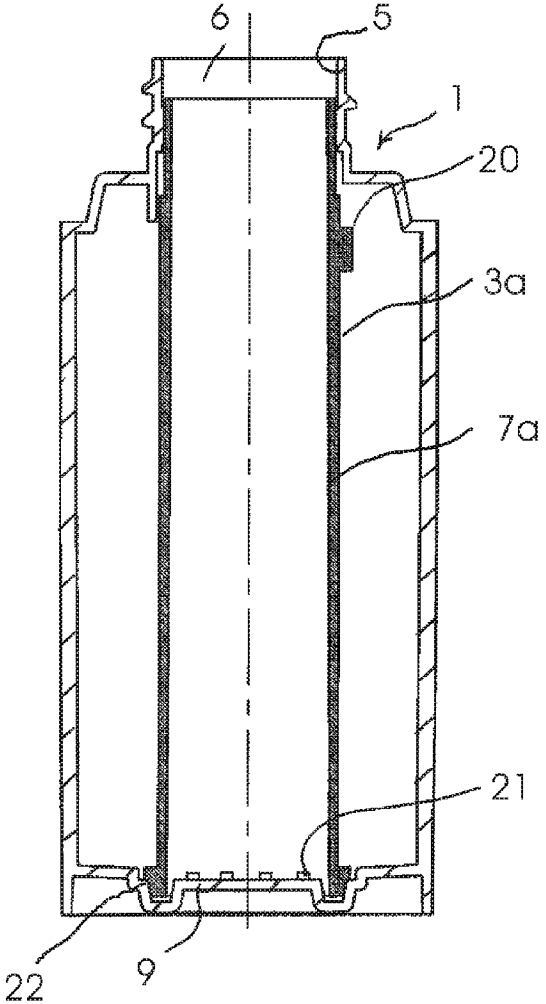
FIGS. 2A-B show a second exemplary embodiment of a liquid container according to the present invention having an extraction chimney with two different limit settings for the liquid permeability of the liquid-permeable zone of the extraction chimney.
Figure 2A:
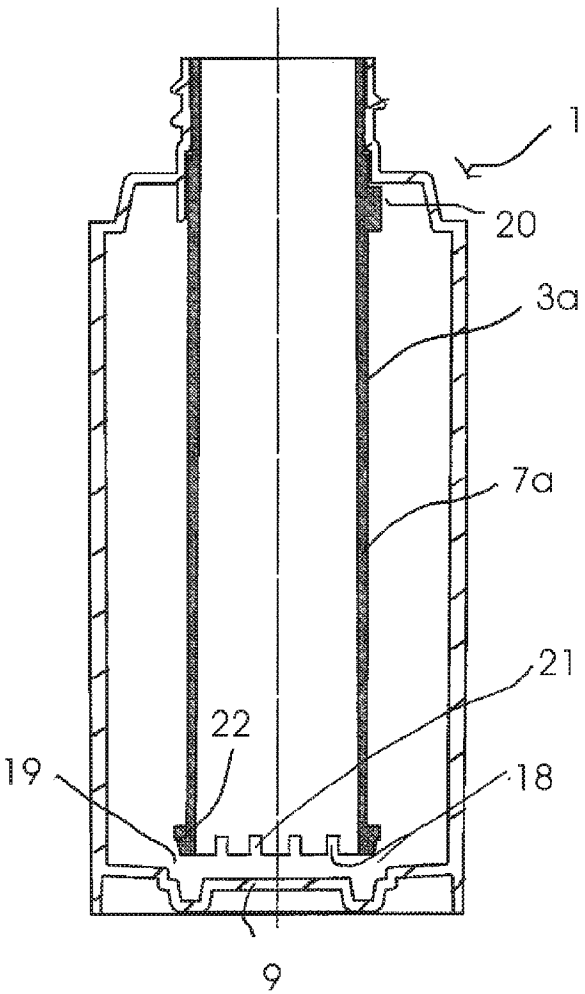

In the second exemplary embodiment illustrated in FIGS. 2*a* and 2*b*, identical designations have been used for elements which essentially correspond, in terms of functioning, to the elements in FIGS. 1*a* and 1*b*. The following explanations may thus be restricted to the differences of the second exemplary embodiment in relation to the first exemplary embodiment.

In the case of the second exemplary embodiment, the liquid permeability of the liquid-permeable zone 18 can be varied by a lifting movement of the tube portion 7*a* relative to the container base 9. The liquid-permeable zone can be defined by the annular gap 19, which may be larger when the extraction-chimney tube portion 7*a* is raised as shown in FIG. 2*a* than when the extraction-chimney tube portion 7*a* is lowered as shown in to FIG. 2*b*. The annular gap 19 can also be defined by crenellation interspaces 21. Stop means 20 and 22 can help ensure that defined end positions are possible for the lifting adjustment of the tube portion 7*a*, as illustrated in FIGS. 2*a* and 2*b*. FIG. 2*a* illustrates the limit setting for the positioning of the extraction chimney 3*a* for the operation of filling the liquid container 1. FIG. 2*b* illustrates that limit setting for the positioning of the extraction chimney 3*a* for the liquid-extraction operation. However, when the tube portion 7*a* is in the setting for minimal liquid permeability of the liquid-permeable zone according to FIG. 2*b*, there can be exchange of liquid taking place through the liquid-permeable zone 18.

Figure 3B:
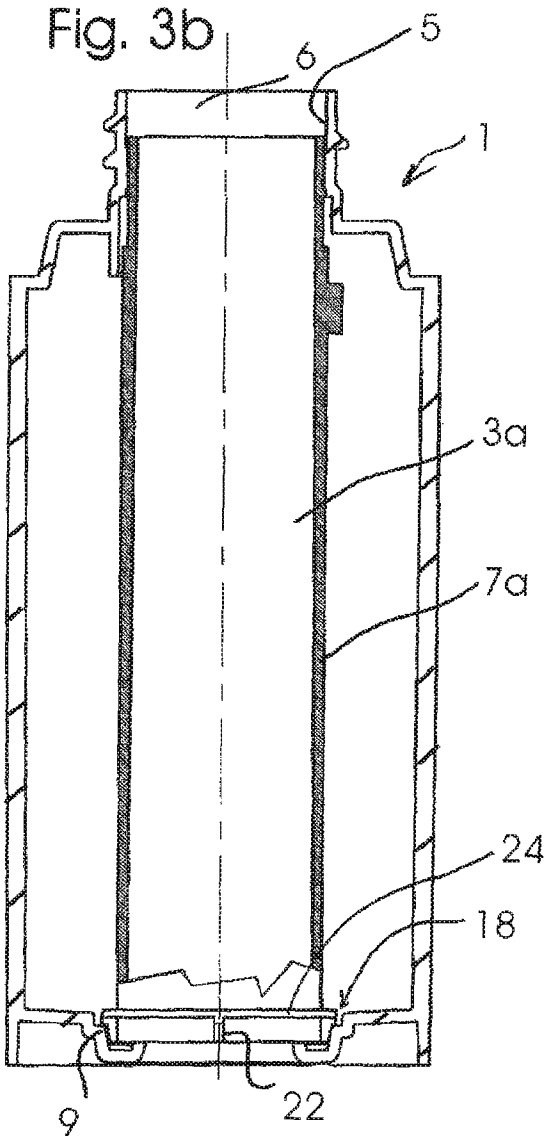
FIGS. 3A-B illustrate a variant of the second exemplary embodiment of FIGS. 2A-B of the present invention.
Figure 3A:
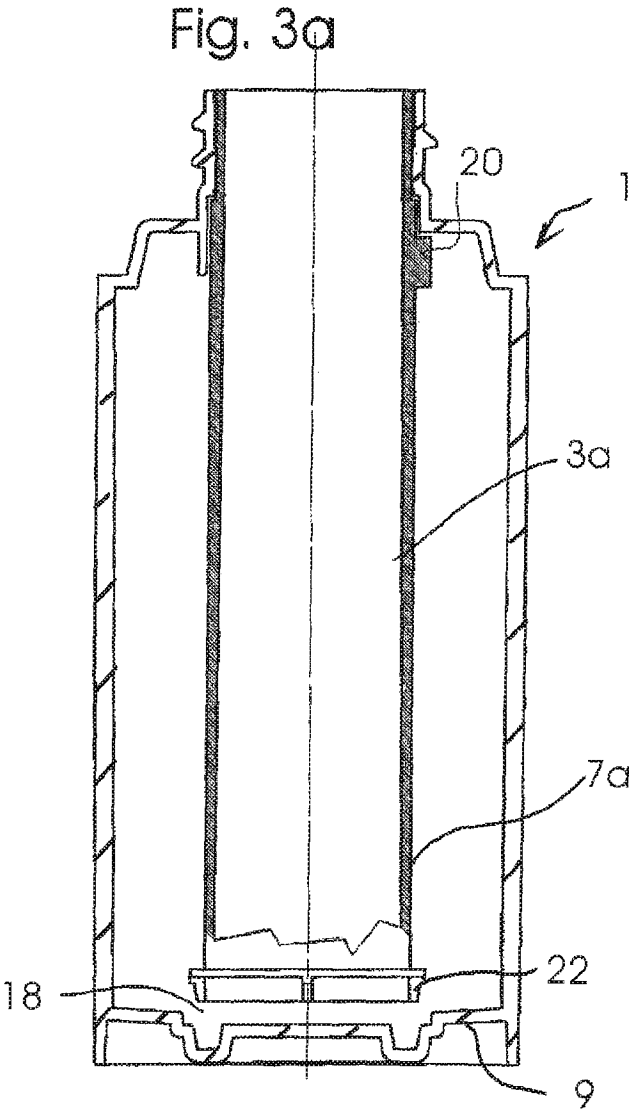

FIGS. 3*a* and 3*b* illustrate a variant of the second exemplary embodiment. FIGS. 3*a* and 3*b* illustrate a modification to the bottom end of the tube portion 7*a*. The bottom end of the tube portion 7*a* can have four spacing webs 22. The spacing webs can help ensure that, when the tube portion 7*a* is in the lowered state as illustrated FIG. 3*b*, the tube portion 7*a* does not have its bottom end resting with closing action on the container base 9. Additionally, a collar 24 can run around the circumference of the bottom end of the tube portion 7*a*. The collar 24 can help maintain a spacing from the container base 9. This spacing can allow liquid communication between the interior of the extraction chimney 3*a* and the liquid container volume outside the extraction chimney to take place through the liquid-permeable zone 18 in reduced liquid permeability setting as illustrated in FIG. 3*b*. FIG. 3*a* illustrates the setting of the extraction chimney 3*a* that can provide for the operation of filling the liquid container 1. FIG. 3*b* illustrates the setting position of the extraction chimney 3*a* that can provide for liquid-extraction operation.

Numerous modifications of the exemplary embodiments described are conceivable. Thus, for example, the extraction chimney can be adjusted, for example, by a combined lifting and rotary movement. This may be, in particular, a screwing-action movement of the extraction chimney.

Additionally, the extraction chimney can be fitted into the liquid container before the liquid container is filled.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A liquid container fillable with liquid for use in high throughput automatic analyzers comprising a top opening, an extraction chimney and a base, wherein the extraction chimney extends into the liquid container and is aligned with the top opening of the liquid container, the extraction chimney comprises a liquid-permeable zone proximate to a bottom region of the extraction chimney and adjacent to the container base of the liquid container, wherein liquid permeability of the liquid-permeable zone of the extraction chimney can be adjusted between a setting of minimal liquid permeability and a setting for greater liquid permeability while the extraction chimney remains in the liquid container, wherein the liquid can be withdrawn from the liquid container by a liquid extraction element introduced into the extraction chimney through the top opening when the liquid permeability is set at the setting of minimal liquid permeability, wherein the extraction chimney comprises a tube portion extending downwards from the top opening, wherein a bottom portion of the tube portion is in the vicinity of the base, and wherein the extraction chimney comprises spacing webs and a collar running around the bottom portion of the tube portion circumference.

2. The liquid container of claim 1, wherein the liquid-permeable zone comprises, at least one opening in the bottom region of the extraction chimney with an opening cross section that can be adjusted to set the liquid permeability of the liquid-permeable zone.

3. The liquid container of claim 2, wherein the opening cross section of the liquid-permeable zone can be adjusted by a rotary movement of the extraction chimney relative to the liquid-container base.

4. The liquid container of claim 3, wherein the setting for minimal liquid permeability has a defined stop position.

5. The liquid container of claim 3, wherein the rotary setting movement of the extraction chimney can be made between at least two defined stop positions assigned to different opening cross sections.

6. The liquid container of claim 2, wherein the opening cross section of the liquid-permeable zone can be adjusted by a lifting movement of the extraction chimney relative to the liquid-container base.

7. The liquid container of claim 5, wherein the setting for minimal liquid permeability has a defined latching position.

8. The liquid container of claim 5, wherein the lifting setting movement of the extraction chimney can be made between at least two latching positions assigned to different opening cross sections.

9. The liquid container of claim 2, wherein the opening cross section of the liquid-permeable zone can be adjusted by a rotary and lifting movements of the extraction chimney relative to the liquid-container base.

10. The liquid container of claim 1, further comprises:

a tube holder provided on the base in communication with the bottom portion of the tube portion of the extraction chimney, wherein the tube portion and the tube holder fit inside each other and are adjusted relative to one another to change opening cross section of the liquid-permeable zone.

11. The liquid container of claim 1, further comprises:

a tube holder provided on the base in communication with the bottom portion of the tube portion of the extraction chimney wherein the liquid-permeable zone incorporates lateral openings in the tube portion and lateral openings in the tube holder in the bottom region of the extraction chimney, wherein the lateral openings of the tube portion and the lateral openings of the tube holder are aligned relative to one another to increase the opening cross section of the liquid-permeable zone.

12. The liquid container of claim 1, wherein the extraction chimney is secured in the liquid container when the liquid container is open.

13. The liquid container of claim 1, wherein the extraction chimney cannot be removed from the liquid container under normal handling conditions.

14. The liquid container of claim 1, wherein the liquid extraction element is a pipette.

15. A liquid container fillable with liquid for use in high throughput automatic analyzers comprising:

a top opening;

an extraction chimney;

a base, wherein the extraction chimney extends into the liquid container and is aligned with the top opening of the liquid container, the extraction chimney comprises a liquid-permeable zone proximate to a bottom region of the extraction chimney and adjacent to the base of the liquid container, wherein liquid permeability of the liquid-permeable zone of the extraction chimney can be adjusted between a setting of minimal liquid permeability and a setting for greater liquid permeability while the extraction chimney remains in the liquid container, wherein the liquid can be withdrawn from the liquid container by a liquid extraction element introduced into the extraction chimney through the top opening when the liquid permeability is set at the setting of minimal liquid permeability, wherein the extraction chimney comprises a tube portion extending downwards from the top container opening, wherein a bottom portion of the tube portion is in the vicinity of the base; and a tube holder provided on the base in communication with the bottom portion of the tube portion of the extraction chimney, wherein the tube portion and the tube holder fit inside each other and are adjusted relative to one another to change opening cross section of the liquid-permeable zone.

16. The liquid container of claim 15, wherein the extraction chimney is secured in the liquid container when the liquid container is open.

17. The liquid container of claim 15, wherein the extraction chimney cannot be removed from the liquid container under normal handling conditions.

18. The liquid container of claim 15, wherein the liquid extraction element is a pipette.

19. A method for providing a liquid in an automatic analyzer which comprises utilizing the liquid container of claim 1 by filling the liquid container with the liquid and providing the filled liquid container to the automatic analyzer.

20. A method for providing a liquid in an automatic analyzer which comprises utilizing the liquid container of claim 15 by filling the liquid container with the liquid and providing the filled liquid container to the automatic analyzer.

* * * * *